United States Patent [19]

Wyne

[11] Patent Number: 4,773,779

[45] Date of Patent: Sep. 27, 1988

[54] PRINTER RIBBON CARTRIDGE WITH FLEXIBLE RIBBON GUIDES AND INTEGRAL RIBBON SHIELD

[75] Inventor: Amjad S. Wyne, Charlotte, N.C.

[73] Assignee: International Business Machines Corporation, Armonk, N.Y.

[21] Appl. No.: 23,998

[22] Filed: Mar. 10, 1987

Related U.S. Application Data

[63] Continuation of Ser. No. 807,922, Dec. 11, 1985, abandoned.

[51] Int. Cl.[4] ..... B41J 35/04

[52] U.S. Cl. ..... 400/247; 400/208; 400/248

[58] Field of Search ..... 400/56, 124, 195, 196, 400/196.1, 207, 208, 208.1, 46.1, 216.2, 240, 240.4, 247, 248, 636

[56] References Cited

U.S. PATENT DOCUMENTS

| | | | |
|---|---|---|---|
| 3,592,311 | 7/1971 | Chou et al. | 400/124 |
| 3,874,285 | 4/1975 | Kodaira et al. | 400/248 X |
| 3,897,865 | 8/1975 | Darwin et al. | 400/124 |
| 3,904,017 | 9/1975 | Frechette | 400/208 X |
| 3,995,731 | 12/1976 | Miller et al. | 400/208.1 X |
| 4,047,608 | 9/1977 | Willcox | 400/208 |
| 4,165,188 | 8/1979 | Rempel | 400/248 X |
| 4,197,023 | 4/1980 | Deboo et al. | 400/56 X |
| 4,236,839 | 12/1980 | Mueller | 400/216.1 |
| 4,277,187 | 7/1981 | Rello | 400/208 X |
| 4,280,767 | 7/1981 | Heath | 400/247 |
| 4,285,604 | 8/1981 | Rey | 400/247 |
| 4,325,645 | 4/1982 | Miyajima et al. | 400/248 X |
| 4,384,794 | 5/1983 | Okano et al. | 400/636 X |
| 4,407,595 | 10/1983 | Gershnow | 400/208 X |
| 4,410,291 | 10/1983 | Speraggi | 400/247 X |
| 4,425,046 | 1/1984 | Van Horne et al. | 400/208 |
| 4,437,401 | 3/1984 | Heinrich et al. | 400/248 X |
| 4,444,522 | 4/1984 | Suzuki et al. | 400/247 X |
| 4,492,484 | 1/1985 | Akazawa et al. | 400/248 |
| 4,496,256 | 1/1985 | McMorrow et al. | 400/248 |
| 4,563,100 | 1/1986 | Hamamichi | 400/208 |
| 4,571,102 | 2/1986 | Ono et al. | 400/248 |
| 4,632,583 | 12/1986 | Nash | 400/248 |
| 4,643,601 | 2/1987 | Nash et al. | 400/248 X |

OTHER PUBLICATIONS

IBM Technical Disclosure Bulletin, "Detentable Ribbon Shield", Matuck et al, vol. 16, No. 3, Aug. 1973, pp. 834–835.

IBM Technical Disclosure Bulletin, "Ribbon Shield Structure for Printer", Olson et al, vol. 26, No. 1, Jun. 1983, pp. 65–66.

IBM Technical Disclosure Bulletin, "Ribbon Guide and Shield for Wire Matrix Printer", Habich, vol. 26, No. 1, Jun. 1983, p. 73.

*Primary Examiner*—Ernest T. Wright, Jr.

*Attorney, Agent, or Firm*—K. A. Seaman

[57] ABSTRACT

A printer ribbon cartridge having flexible ribbon guides and an integral, resilient ribbon shield in pressure contact with paper to deaden noise from the printing operation. Also disclosed is a method of preparing paper which may have been folded or had corners bent from handling for printing and feeding through a printer in which the ribbon shield is pressed against the paper while the printer head carriage traverses across the paper to flatten the paper and urge the paper toward a nip of opposed paper feed rolls of a paper handling module associated with the printer.

7 Claims, 5 Drawing Sheets

Fig. 2
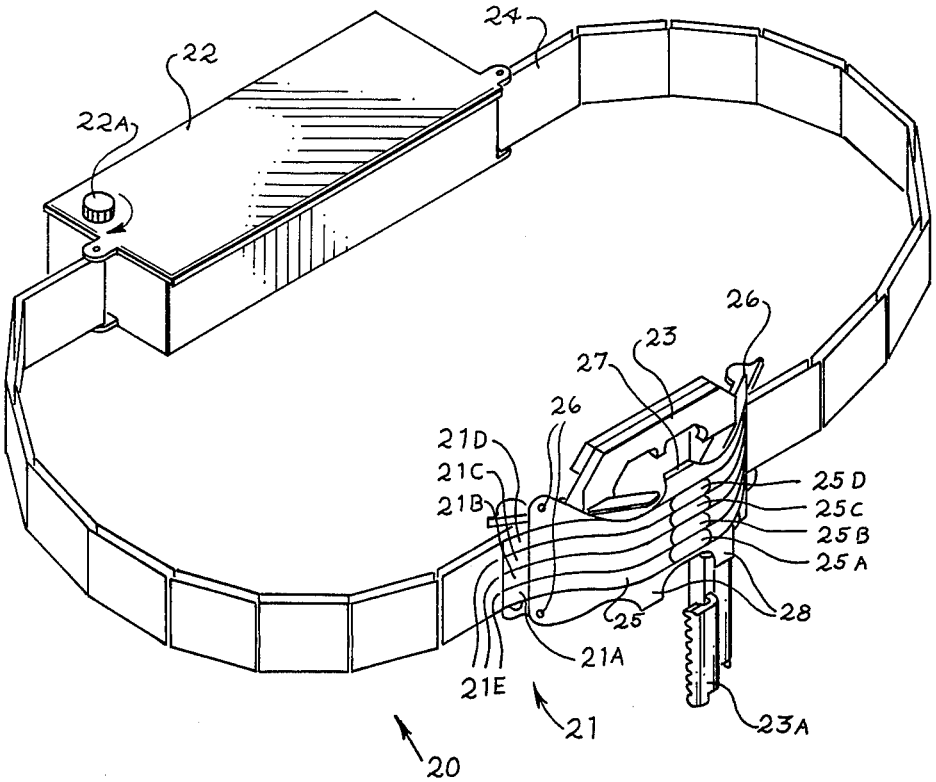
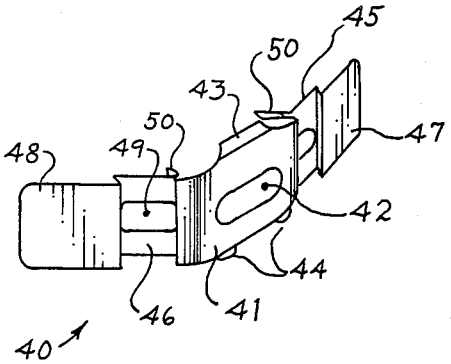
Fig. 5

PRINTER RIBBON CARTRIDGE WITH FLEXIBLE RIBBON GUIDES AND INTEGRAL RIBBON SHIELD

CROSS REFERENCE TO RELATED PATENTS

This application is a continuation of application Ser. No. 807,922, filed Dec. 11, 1985, now abandoned.

The present invention is related to a patent application Ser. No. 656,816 relating to a ribbon guide assembly entitled "Flexible Leader" filed Oct. 1, 1984 by Dennis Nash and assigned to the assignee of the present invention, now U.S. Pat. No. 4,632,583 issued Dec. 30, 1986. This patent application is sometimes referred to herein as the "Ribbon Guide Patent application".

The present invention is also related to a patent application Ser. No. 655,496 entitled "Ribbon Positioning Mechanism" filed Sept. 28, 1984 by Dennis Nash et al., now U.S. Pat. No. 4,643,601 issued Feb. 17, 1987 and assigned to the assignee of the present application. This patent application Ser. No. 655,496 is referred to in this patent application as the "Ribbon Positioning Patent application".

The present invention is also related to a patent application Ser. No. 807,519 entitled "Printer with Removable and Interchangeable Paper Feed Modules" filed Dec. 11, 1985 by D. K. Rex et al., now U.S. Pat. No. 4,671,686 issued June 9, 1987 and assigned to the assignee of the present invention. This patent application will occasionally be referred to as the "Paper Module Patent application" in this patent application.

The specification and drawings of the Ribbon Guide Patent application, the Ribbon Positioning Patent application and the Paper Module Patent application are all specifically incorporated herein by reference.

BACKGROUND OF THE INVENTION

1. Field of the Invention

The present invention relates to printing intelligence on paper. More particularly, the present invention relates to a ribbon shield apparatus for preventing unwanted contact between the ribbon and the paper (causing ink smudges on the paper) during relative movement of the ribbon and paper.

2. Background Art

Several types of impact printers are known today. Many include a fixed platen and a movable print head carriage including a plurality of spaced print wires which are selectively activated and driven into a ribbon and the paper as the head moves across the paper. Such printers are illustrated by U.S. Pat. Nos. 3,592,311 and 3,897,865.

Printers create a substantial amount of noise during print wire activation and contact of the wires with the ribbon, paper and the platen. This noise increases as printers are driven at ever increasing printing rates, now approaching or exceeding 400 characters per second in some printers. This high speed requires more wire activations and platen contacts per unit of time. Current printers generate more noise as greater forces are employed to complete a firing sequence in a shorter period of time (when the print head is in the proper printing location.)

Another problem with printing at ever increasing speeds is that the ribbon is positioned closer to the paper, making it more likely to come into unwanted contact with the paper, leaving smudges and other undesirable markings. In some printers, the print head and the paper are placed in close proximity (perhaps 0.4 millimeter separation) to permit short cycles required in high speed printing, but the ribbon is located between the print head and the paper. Further, the movement of the print head at increased speeds tends to make the ribbon more likely to come into contact with the paper.

One solution which addresses the noise problem as well as the ribbon contact with paper is to mount a ribbon shield on the print head carriage and place it in frictional engagement with the paper. An example of this solution is shown in U.S. Pat. No. 4,410,291. While this reduces the noise created during printing and reduces the unwanted ribbon marking on the paper, the frictional engagement creates wear on the ribbon shield. The wear on the ribbon shield creates failure of the ribbon shield, necessitating periodic replacement. This replacement requirement dictates that an additional supply item (the ribbom shield) be manufactured and distributed so that the user can have his printer repaired as required. This also dictates that a mounting surface and removable mounting hardware be provided in the region of the print head and the ribbon, adding to the already crowded viscinity and possibly requiring greater distance between the print head and the paper. This patent teaches the use of a ribbon shield of approximately 1 millimeter in thickness, which is more than twice as large as the head-to-paper separation in current printers. The ribbon shield of this patent thus could not be used in current printers.

This U.S. Pat. No. 4,410,291 also shares a disadvantage with other printers in that the ribbon shield and the ribbon may be movable with respect to each other. Relative movement of the ribbon with respect to the ribbon shield means that varying portions of the ribbon may be aligned with the print head and an aperture in the ribbon guide at varying times. In the case of a multicolor ribbon, this varying of alignment may mean that a wrong color is printed or that printing partially in two different colors may occur. Both results are, of course, undesirable.

Documents on which printing is desired frequently do not have the stiffness and flatness necessary to feed the paper in the desired path. This is particularly true for a car rental agreement where the calculation of a customer's bill is desired on the form which the customer has been carrying. This carried form may have been folded and its corners bent. In many printers, such a form could either not be handled well or would require manual preparation for printing.

A moving print head carriage has a tendency to snag on portions of paper inserted in a printer. This snagging potential is especially prevalent at edges of paper such as multiple part forms and at "outfolds" where continuous form paper joins together at joints which project out from the platen and into the moving print head.

Cost of manufacturing, assembly and maintenance are considerations regarding all printers and printer ribbons. Many ribbon shield "solutions" proposed previously are expensive either to fabricate and assemble or to maintain. Accordingly, the resulting printer product is either too expensive or relatively uneconomical.

Some printer ribbon assemblies include a small, rather delicate ribbon guide in the vicinity of the print head to achieve a low mass ribbon guide assembly. However, the delicateness of the ribbon guide also allows it to bend stretch and deform during ribbon installation. Any associated structure mounted on the ribbon guide must either have similar capabilities or will break.

Various examples of printer shields are known in the prior art. Examples of these include those shown in U.S. Pat. Nos. 4,165,188; 4,285,604; 4,437,401; and 4,496,256 and in IBM Technical Disclosure Bulletin Vol. 16, No. 3, p. 834; Vol. 26, No. 1, p. 65; and Vol. 26, No. 1, p. 73.

Other limitations and disadvantages of the prior art systems will be apparent to those skilled in the art in view of the description of the present invention.

SUMMARY OF THE PRESENT INVENTION

The present invention overcomes the disadvantages and limitations of the prior art printing systems by providing a ribbon shield which is integral with the ribbon cartridge and is mounted in frictional engagement with the paper when the ribbon is installed so that noise from the printing operation is reduced.

The integral mounting of the ribbon shield on the ribbon cartridge provides for its automatic replacement with each ribbon cartridge. In this way, any wear on the ribbon shield can be ignored, because the ribbon shield is replaced with each new ribbon. Accordingly, no separate ribbon shield needs to be inventoried, nor separately changed.

The association of the ribbon shield with the ribbon cartridge also means that the ribbon shield will always be matched to the ribbon. Otherwise, the possibility exists that a multi-color ribbon shield would be installed on a printer which has a single color ribbon included therein. Such a mismatched ribbon shield could lead to transfer of ink of a different color to a ribbon or an attempt to print through a ribbon guide in a region where no aperture exists. Also, the present mounting of the ribbon shield on the ribbon guide means that the apertures in the ribbon guide will be positioned in appropriate spacial relationship with the print head and the color bands on the ribbon.

A further advantage of the present invention of an integral ribbon shield is that no special mounting between the ribbon shield and the print head carriage is necessary. This eliminates labor necessary to install such a ribbon shield during manufacture of the printer and also the labor of a serviceman to adjust or replace the ribbon shield during use of the printer. It also means one fewer part which can fail and remove the printer from service.

This invention has the advantage that low manufacturing cost of the ribbon shield can be achieved.

The present invention also has the advantageous effect that undesired smudges of the ribbon against the paper are greatly reduced, and possibly eliminated. The present ribbon shield also reduces the chance of ribbon snagging at the edges of the paper or at outfolds in continuous form paper by providing ramps which allow the print head assembly to move over such edges.

The ribbon shield of an alternate design has the additional advantage that it can bend stretch and deform as the ribbon and the ribbon guide are bent, stretched and deformed, without breaking or permanently deforming.

The frictional or pressure engagement of the ribbon shield against the paper allows a pass of the print head (without printing) to flatten a document which has been folded or bent. For example, this pass of the print head across the width of the document urges the document into a nip of opposed upper rollers carried on the paper modules of the Paper Module U.S. Pat. No. 4,671,676. In such a manner, the paper can be directed in a desired direction in an automatic operation of the printer, without requiring time and efforts of an attendant. Such automatic operation clearly reduces the difficulty and labor cost of the operation.

Other objects and advantages of the present invention will be apparent to those skilled in the art of designing printing apparatus and the ribbon assemblies useful therein, particularly in view of the following detailed description of the preferred embodiment taken with the appended claims and the accompanying drawings.

BRIEF DESCRIPTION OF THE DRAWINGS

FIG. 2 is a perspective view of a ribbon cartridge including a printer ribbon shield for the printer of FIG. 1.

FIG. 5 is a perspective view of a ribbon shield of an alternative design to that shown in FIG. 2.

BEST MODE OF CARRYING OUT THE INVENTION

Figure 1:
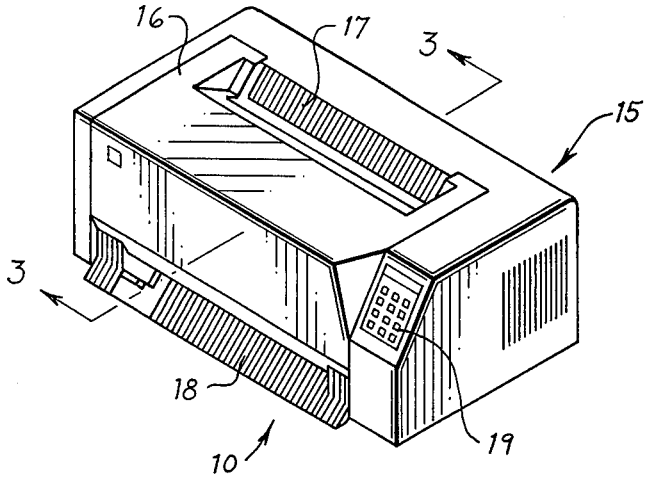
FIG. 1 is a perspective view of a printer useful in the present invention.

As shown in FIG. 1, a printer 10 includes an outer housing 15 which generally covers the inner working parts of the printer 10. An access cover 16 is hingedly connected at its upper rear portion to the outer housing 15. The hinged junction of the access cover 16 and the outer housing 15 provides a paper exit slot, broadly indicated by the reference numeral 17. At the juncture of the lower front of the access cover 16 and the housing 15, an inclined surface on the housing 15 defines a paper entry slot 18. An operator control panel 19 is positioned adjacent the paper path between the paper entry slot 18 and the paper exit slot 17 and provides communication between the printer 10 and the operator.

FIG. 2 shows a perspective view of a ribbon cartridge assembly 20 having a ribbon 21 which is guided from a ribbon box 22 to a ribbon guide 23 (also referred to as a "nose piece" in the Ribbon Guide U.S. Pat. No. 4,632,583) in a flexible leader or guide belt 24. The ribbon box 22 has a ribbon take-up knob 22A, which is well known in the art, for manually advancing the ribbon 21. The preferred form of a flexible leader or guide belt 24 is shown in the Ribbon Guide U.S. Pat. No. 4,632,583 incorporated herein. The ribbon 21 is preferably a four color ribbon in which longitudinal bands 21A, 21B, 21C, 21D of four different colors are each separated from the adjacent band by an ink barrier 21E.

A ribbon shield 25 is secured by rivets 26 to the ribbon guide 23 at each of its four corners. The ribbon shield 25 is made of a thin piece of plastic such as the plastic film sold under the trademark Mylar and is longer than the distance between the ends of the ribbon guide 23 at the ends so that the ribbon shield 25 bows outward from the ribbon guide 23. Since the ribbon shield 25 is made of clear plastic material in its preferred embodiment, the multi-color bands 21A, 21B, 21C, 21D of the ribbon 21 are seen through the ribbon shield 25 in this view. The ribbon shield 25 includes a plurality of apertures 25A, 25B, 25C, 25D, each aligned with one of the multi-color bands 21A, 21B, 21C, 21D of the ribbon 21 and positioned in front of the print head 34 (not shown in this view) when that color is being printed.

A rack 23A portion of the ribbon guide 23 is shown as described in the Ribbon Positioning U.S. Pat. No. 4,463,601 to lift the ribbon 21, the ribbon guide 23 and the ribbon shield 25 to change the color of printing. The ribbon shield 25 includes an inwardly bent tab 27 (which extends toward the ribbon guide 23 and the print head 34 and away from the paper 33 at approximately a 45 degree angle) which allows the ribbon 21 to be lifted for a change of color without snagging even if printing is at the top of a page which has an outfold immediately above. In a similar manner, the bottom of the ribbon shield 25 is provided with two inwardly bent projections 28 which allow shifting of a ribbon 21 even toward the bottom of a page which is immediately above an outfold. Again, the projections 28 extend inwardly at about a 45 degree angle. While the upper projection 27 is a single projection, the lower projections 28 are a pair of projections, each spaced from the center line to allow the ribbon 21 and ribbon shield 25 to be inserted over the print head 34 with a minimum thickness (the ribbon shield 25 itself) in the lower center region which must pass between the print head 34 and the platen 30.

The ribbon 21 shown and described in the foregoing embodiment is a multi-color ribbon of the type used in a color printer. However, the ribbon positioning and ribbon shield 25 of the present invention are equally useful with a multi-band, single color ribbon 21. In such a ribbon, all bands 21A, 21B, 21C, 21D are a single color such as black, but it is desirable to use first one hand, then sequentially move the ribbon 21 to the next band until it is used, thereby increasing the length of time between necessary ribbon changes.

Figure 3:
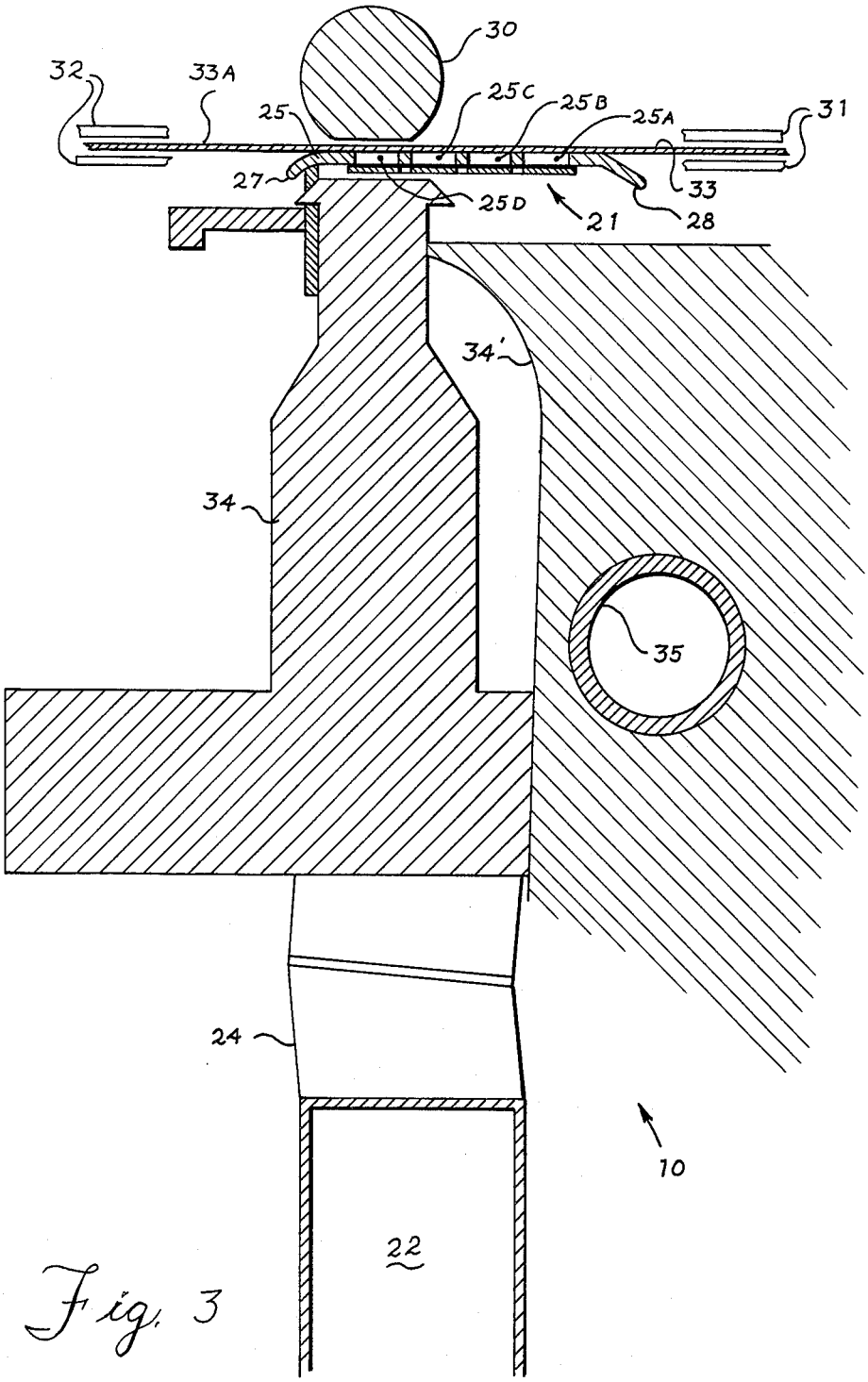
FIG. 3 is a partial side view of the printer of FIG. 1, partially cut away along section line 3—3 in FIG. 1 with a ribbon cartridge of the type shown in FIG. 2 mounted therein.

FIG. 3 shows a cut away partial side view of the printer 10 including the ribbon 21 and ribbon shield 25. A platen 30 is shown, with lower paper guide 31 and upper paper guide 32 shown directing paper 33 between the platen 30 and a print head 34. The ribbon box 22 is mounted on the printer 10. The print head carriage 34' moves along a support rod 35. The ribbon shield 25 includes the apertures 25A, 25B, 25C, 25D and the upper bent portion 27 and the lower bent portions 28.

Figure 4:
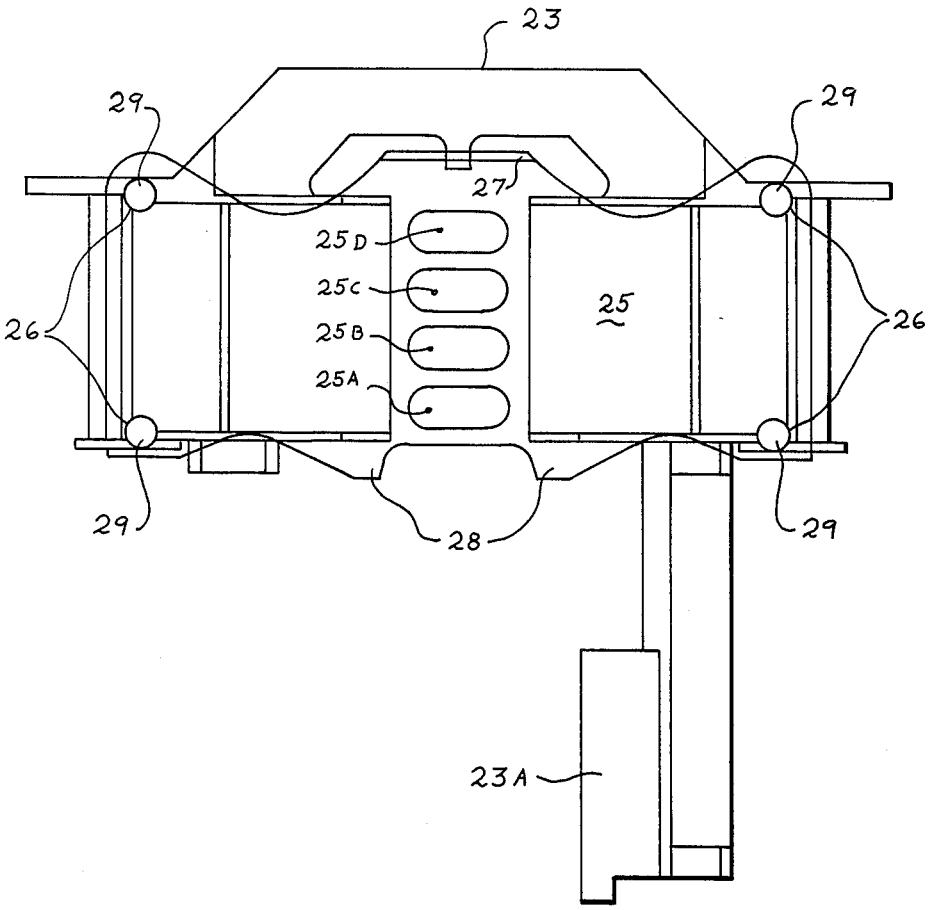
FIG. 4 is an enlarged view of the ribbon guide and ribbon shield of the present invention.

FIG. 4 is a front view of the ribbon shield 25. The shield 25 consists of a thin piece of flexible and resilient plastic film material such as is sold under the trademark Mylar. Apertures 25A, 25B, 25C, 25D are located medially along the width of the ribbon shield 25 and are arranged one above the other. Each aperture 25A, 25B, 25C, 25D is positioned to be medial along the height of one ribbon section so that printing can be confined to a predetermined vertical region of the ribbon 21. The rivets 26 mount the ribbon shield 25 on the ribbon guide 23 through mounting holes 29 located toward each of the four corners of the ribbon shield 25.

FIG. 5 is a perspective view of an alternative embodiment of the present invention, in which a ribbon shield 40 includes a central section 41 wnich is bowed outward and into a pressure contact with the paper 33 and the platen 30 when the ribbon shield 40 is mounted on the ribbon guide 55 (not shown in this Figure.) The central section 41 includes an aperture 42 through which printing may occur, an aperture 42 which is aligned with the print head 34 and a selected region of the ribbon 54. This aperture 42 is preferably defined by generally parallel upper and lower surfaces and semi-circular ends connecting the upper and lower surfaces in a rounded arc which makes snagging of the ribbon 54 unlikely. An upper projection 43 is bent inwardly at approximately a 45 degree angle to provide a ramp which prevents the upper outfolds from catching on the ribbon shield 40. A pair of lower projections 44, also extending inwardly toward the print head 34 are located on the lower edge of the bottom of the central section 41, spacced from the center line of the ribbon shield 40 to allow the ribbon guide 55 to be installed over the print head 34 despite its close proximity to the paper 33 and platen 30.

Immediately adjacent to the central section 41 are indented sections 45, 46 which are spaced rearwardly of the central section 41. Remote ramps 47, 48 are spaced outwardly from the indented sections 45, 46, respectively, and project back outwardly from the indented sections 45, 46. As will be apparent from the latter description of FIG. 7, these indented sections 45, 46 allow a retaining clip 56 to pass forward of the indented sections 45, 46 while the retaining clip 56 remains behind a plane passing from the outer edge of the center section 41 to the adjacent remote ramp (47 or 48 as the case may be.) In this manner, paper 33 supported by the platen 30 may pass smoothly over the ramps 47 or 48 and the central section 41 without catching in the clips 56 which secure the ribbon shield 40 in place, all as depicted in connection with FIG. 7. Apertures 49 in the indented sections 45, 46 reduce drag on the ribbon 54 as the ribbon 54 passes by the indented sections 45, 46.

Figure 6:
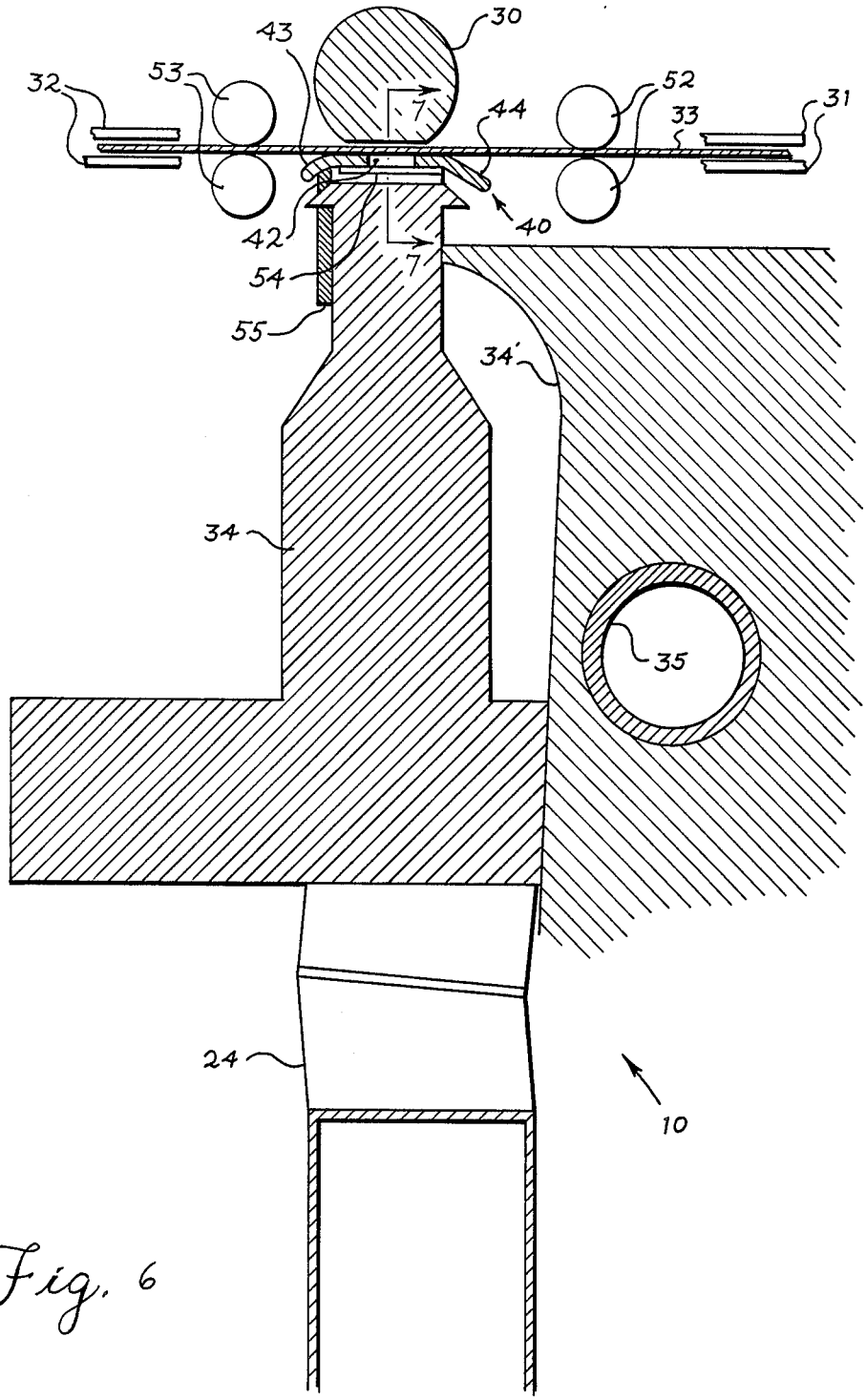
FIG. 6 is a partial side view of the alternative design ribbon shield of FIG. 5 mounted in the printer of FIG. 1. As such, this view is analogous to FIG. 3, but using a different ribbon and ribbon shield.

FIG. 6 illustrates a portion of the printer 10 of the present invention with the ribbon 54 and ribbon guide 55 of an alternative embodiment of the present invention. In this view, a printer 10 includes a ribbon box 22 from which a ribbon 54 is threaded through a ribbon guide 55 and back to the ribbon box 22. The print head carriage 34' is mounted on the guide rod 35. Lower paper guide 31 and upper paper guide 32 are shown directing paper 33 through a lower set of feed rolls 52 and an upper set of feed rolls 53, as might be done with document insertion device (DID) feed modules of the type described in the Paper Module U.S. Pat. No. 4,671,686 incorporated herein by reference. The ribbon shield 40 and its upper and lower projections 43, 44 as well as the aperture 42 are depicted in this view.

Figure 7:
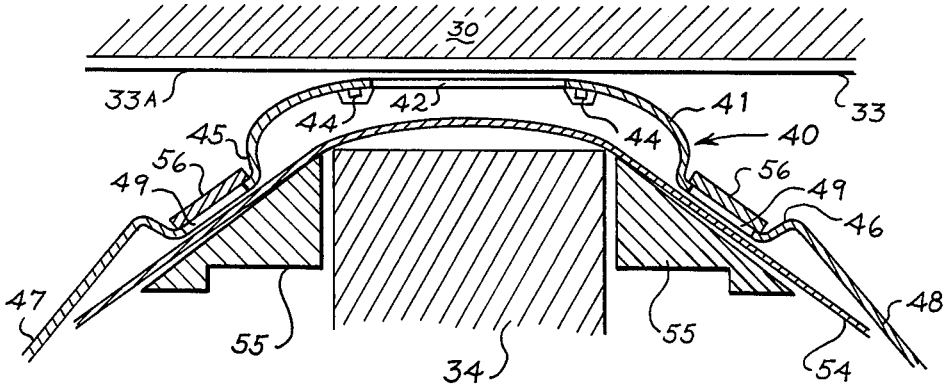
FIG. 7 is a partial cross sectional view of a ribbon, ribbon guide and ribbon shield of the alternative embodiment ribbon shield of FIGS. 5 and 6, taken along section line 7—7 in FIG. 6.

FIG. 7 illustrates a cross sectional view of the assembly of FIG. 6, cut along the line 7—7 looking in the direction of the arrow. The print head 34 is shown between ribbon guide portions 55. Clips 56 extend forward of the ribbon 54 and the ribbon shield 40 in the region of the indented portions 45, 46. These clips 56 extend upwardly from their connection to the ribbon guide 55 below the ribbon 54 and the ribbon shield 40 and latch above the upper surface of the ribbon 54 and the ribbon shield 40, captivating both. Aperture 42 is shown in the ribbon shield 40, through which printing may occur, as well as the apertures 49 in the indented sections 45, 46. The ramps 47, 48 at the distal ends of the ribbon shield 40 are also shown, as is the fact that the clips 56 are depressed below the surface of the ribbon shield central section 41 as it extends to the distal sections 47, 48. The paper 33 and the platen 30 are also shown in this view.

The ribbon shield 25, 40 of either embodiment is advantageously longer in length than the distance between the mounting points, causing it to bow outward and into the paper 33. When the print head 34 is positioned adjacent to the paper 33 in its operational position, this bowing puts the ribbon shield 25, 40 into an interference location, as its desired location would be to project perhaps 2 millimeters further. This interference causes the ribbon shield 25, 40 to press against the paper 33 and reduce the noise created by the printing operation by one, two or more decibels, depending on the design.

The present invention (particularly the alternative embodiment using a single color ribbon 54 and the paper module 33A illustrated in FIGS. 3, 6–7) has particular application to the use of the interchangeable paper modules disclosed in the reference Paper Module U.S. Pat. No. 4,671,686. In that U.S. Pat. No. 4,671,686, for example, a cut-paper form such as a rental car agreement may be fed into the printing region after it has been carried by the renter. In such a case, the form may have been folded, creased, or otherwise wrinkled or distorted. The present invention contemplates that such a paper may not be smooth and flat (even moisture can cause paper to wrinkle) and properly directed to feed from the printing station upward into the nip of the rolls 53 of the upper paper handling apparatus. Accordingly, a longitudinal traverse of the paper 33 by the print head 34 with the ribbon guide 55 in pressure contact with the paper 33 will flatten the paper 33 and guide it into the desired position in the nip between the rolls 53, allowing the paper 33 to pass out through the upper rolls 53 after printing. While this traverse pass of the print head 34 is preferably across the entire page to "iron" or flatten the entire width of the document across its upper edge, some lesser traverse also has a similar advantageous effect of removing or reducing the effect of wrinkles or folds.

Of course, many modifications to the best mode described above can be effected without departing from the spirit of the present invention. The ribbon shield 25, 40 while disclosed in its preferred plastic film material sold under the trademark Mylar, could be manufactured of other resilient, yet long lasting materials if desired. Further, some of the features of the present invention can be used to advantage without the corresponding use of other features. Accordingly, the description of the preferred embodiment should be viewed as merely illustrative of the principles of the present invention and not in limitation thereof. The scope of the present invention is described solely in the claims which follow.

Having thus described my invention, what is claimed is:

1. A ribbon cartridge assembly including a ribbon, and a cartridge including a ribbon supply and take-up for a printer including a movable print head for printing on paper and a platen, the ribbon cartridge assembly comprising:

means for supporting and guiding the ribbon to position a desired portion of the ribbon between the print head and the paper when said assembly is mounted in a printer, said ribbon supporting and guiding means being mountable on the print head and movable therewith;

means for transporting the ribbon from the cartridge including the ribbon supply and take-up to one side of the ribbon supporting and guiding means and from the other side of the ribbon supporting and guiding means to the cartridge including the ribbon supply and take-up, said transporting means being secured to the ribbon supporting and guiding means and to the cartridge including the ribbon supply and take-up; and a resilient ribbon shield integrated with the ribbon supporting and guiding means and bowed outwardly toward the paper to contact the paper and provide a pressure contact against the paper and the platen when the ribbon cartidge assembly is mounted on the printer, said ribbon shield having at least one flexible inwardly bent tab at the upper edge thereof and at least two flexible inwardly bent tabs at the lower edge thereof, said ribbon shield including at least one aperture to allow printing to occur therethrough but providing protection against other portions of the ribbon contacting the paper in unwanted regions and providing, through the pressure contact of the ribbon shield against the paper, sound dampening to reduce the noise from printing which travels from the printing region, ironing action to flatten wrinkles in the paper as the print head transverses the paper, and ironing action to flatten the edge of the paper when paper is inserted into the printer.

2. A method of flattening an edge of a document to be printed in a printer having a print head which traverses across the document supported from behind by a platen, with a ribbon cartridge assembly including an integrated ribbon shield, a ribbon, a ribbon support and guiding means, and a cartridge including a ribbon supply and take-up, said ribbon shield being disposed between the print head and the document, said ribbon shield having at least one flexible inwardly bent tab at the upper edge thereof and at least two flexible inwardly bent tabs at the lower edge thereof, the steps of the method including:

inserting the document into the printer between the platen and the print head with the ribbon shield in pressure engagement with the document;

moving the print head and ribbon shield to traverse across at least a portion of the width of the document to thereby urge the document flat against the platen by virtue of the pressure of the ribbon shield on the document; and then printing on the document.

3. A method of guiding an edge of a document to be printing into feed rolls of a printer having a print head and a ribbon cartridge assembly including an integrated ribbon shield, a ribbon, a ribbon support and guiding means, and a cartridge including a ribbon supply and take-up, said ribbon shield having at least one flexible inwardly bent tab at the upper edge thereof and at least two flexible inwardly bent tabs at the lower edge thereof, said shield being positioned to be in pressure contact with the document when the print head traverses across the document, said document being supported by a platen, the steps of the method including:

inserting the document into the printer between the platen and the print head with the ribbon shield in pressure engagement with the document;

moving the print head and ribbon shield across at least a portion of the width of the document to thereby flatten the edge of the document against the platen and urge the top portion of the document into said feed rolls above the top edge of the document by virtue of the pressure of the ribbon shield on the document as the ribbon shield moves over the width of the document; and then printing on the document.

4. A printer comprising:

a platen mounted on said printer for supporting paper at a printing station;

a print head movably mounted on said printer to traverse across the platen and controlled to print indicia on the paper in response to signals; and a ribbon cartridge assembly replacably mounted on the print head and including a ribbon, a cartridge including a ribbon supply and take-up, a ribbon support mounted on opposite sides of the print head for positioning the ribbon between the print head and the paper on the platen, a guide for transporting ribbon from the cartridge including the ribbon supply and take-up to one side of the ribbon support and from the other side of the ribbon support to the cartridge including the ribbon supply and take-up, and a ribbon shield mounted on the opposite sides of the ribbon support and positioned between the ribbon and the paper to prevent the ribbon from contacting the paper in undesired regions, said ribbon shield having at least one flexible inwardly bent tab at the upper edge thereof and at least two flexible inwardly bent tabs at the lower edge thereof, said ribbon shield including an aperture in the region of desired printing between the print head and the paper and being longer than the distance between its mounting points on the ribbon support so that the ribbon shield bows outwardly toward the paper a distance greater than the separation of the paper from the ribbon support, compressing the ribbon shield in pressure contact with the paper to muffle printing noise, ironing action to flatten wrinkles in the paper as the print head transverses the paper, and ironing action to flatten the edge of the paper when paper is inserted into the printer.

5. A ribbon cartridge assembly including a multi-band ribbon, a ribbon supply, and a ribbon take-up for a printer including a movable print head for printing on paper and a platen, the ribbon cartridge assembly comprising:

means for supporting and guiding the multi-band ribbon to position a desired portion of the multi-band ribbon between the print head and the paper when said assembly is mounted in a printer, said multi-band ribbon supporting and guiding means being mountable on the print head and movable therewith;

means for transporting the multi-band ribbon from the ribbon supply to the ribbon supporting and guiding means and from the ribbon supporting and guiding means to the ribbon take-up, said transporting means being secured to the ribbon supporting and guiding means; and a resilient ribbon shield integrated with the ribbon supporting and guiding means and bowed outwardly toward the paper to contact the paper and provide a pressure contact against the paper and the platen when the ribbon cartridge assembly is mounted on the printer, said ribbon shield being a single piece of plastic material secured at each of its ends and medially provided with a plurality of apertures located one above another, each aperture to allow printing to occur therethrough but providing protection against other portions of the multi-band ribbon contacting the paper in unwanted region, each aperture located adjacent to and associated with a band of the multi-band ribbon, and the means for supporting and guiding the multi-band ribbon includes means for positioning any selected one of the bands and its associated aperture aligned with the print head to print with the selected band through the associated aperture, and providing, through the pressure contact of the ribbon shield against the paper, sound dampening to reduce the noise from printing which travels from the printing region and ironing action to flatten wrinkles in the paper as the print head transverses the paper.

6. A ribbon cartridge assembly including a multi-band ribbon, and a cartridge including a ribbon supply and take-up for a printer including a movable print head for printing on paper and a platen, the ribbon cartridge assembly comprising:

means for supporting and guiding the multi-band ribbon to position a desired portion of the multi-band ribbon between the print head and the paper when said assembly is mounted in a printer, said multi-band ribbon supporting and guiding means being mountable on the print head and movable therewith;

means for transporting the multi-band ribbon from the cartridge including the ribbon supply and take-up to one side of the ribbon supporting and guiding means and from the other side of the ribbon supporting and guiding means to the cartridge including the ribbon supply and take-up, said transporting means being secured to the ribbon supporting and guiding means and to the cartridge including the ribbon supply and take-up; and a resilient ribbon shield integrated with the ribbon supporting and guiding means and bowed outwardly toward the paper to contact the paper and provide a pressure contact against the paper and the platen when the ribbon cartridge assembly is mounted on the printer, said ribbon shield being a single piece of plastic material secured at each of its ends and medially provided with a plurality of apertures located one above another, each aperture to allow printing to occur therethrough but providing protection against other portions of the multi-band ribbon contacting the paper in unwanted regions, each aperture located adjacent to and associated with a band of the multi-band ribbon, and the means for supporting and guiding the multi-band ribbon includes means for positioning any selected one of the bands and its associated aperture aligned with the print head to print with the selected band through the associated aperture, and providing, through the pressure contact of the ribbon shield against the paper, sound dampening to reduce the noise from printing which travels from the printing region and ironing action to flatten wrinkles in the paper as the print head transverses the paper.

7. A ribbon cartridge assembly including a multi-band ribbon, and a cartridge including a ribbon supply and take-up for a printer including a movable print head for printing on paper and a platen, the ribbon cartridge assembly comprising:

means for supporting and guiding the multi-band ribbon to position a desired portion of the multi-band ribbon between the print head and the paper when said assembly is mounted in a printer, said multi-band ribbon supporting and guiding means being mountable on the print head and movable therewith;

means for transporting the multi-band ribbon from the cartridge including the ribbon supply and take-up to one side of the multi-band ribbon supporting and guiding means and from the other side of the multi-band ribbon supporting and guiding means to the cartridge including the ribbon supply and take-up, said transporting means being secured to the multi-band ribbon supporting and guiding means and to the cartridge including the ribbon supply and take-up; and a resilient ribbon shield integrated with the multi-band ribbon supporting and guiding means and bowed outwardly toward the paper to contact the paper and provide a pressure contact against the paper and the platen when the ribbon cartridge assembly is mounted on the printer, said ribbon shield having at least one flexible inwardly bent tab at the upper edge thereof and at least two flexible inwardly bent tabs at the lower edge thereof, said ribbon shield being a single piece of plastic material secured at each of its ends and medially provided with a plurality of apertures located one above another, each said aperture to allow printing to occur therethrough but providing protection against other portions of the multi-band ribbon contacting the paper in unwanted regions, each aperture located adjacent to and associated with a different band of the multi-band ribbon, and the means for supporting and guiding the multi-band ribbon includes means for positioning any selected one of the bands of said multi-band ribbon and its associated aperture aligned with the print head to print with the selected band of said multi-band ribbon through the associated aperture, and providing, through the pressure contact of the ribbon shield against the paper, sound dampening to reduce the noise from printing which travels from the printing region and ironing action to flatten wrinkles in the paper as the print head transverses the paper.

* * * * *